US005976442A

United States Patent [19]

Manning

[11] Patent Number: 5,976,442

[45] Date of Patent: Nov. 2, 1999

[54] APPARATUS AND METHOD TO MANUFACTURE CAST PANELS

[76] Inventor: Michael Manning, 15 Summerfield Avenue, Quakers Hill, NSW 2763, Australia

[21] Appl. No.: 08/909,933

[22] Filed: Aug. 12, 1997

Related U.S. Application Data

[63] Continuation of application No. PCT/AU96/00063, Feb. 9, 1996.

[30] Foreign Application Priority Data

Feb. 17, 1995 [AU] Australia ..... PN 1194

[51] Int. Cl.[6] ..... B28B 1/14; B28B 7/02; B28B 7/18; B28B 7/26

[52] U.S. Cl. ..... 264/228; 249/85; 249/90; 249/94; 249/97; 249/126; 249/133; 249/139; 249/155; 249/163; 264/229; 264/278; 264/279; 264/279.1; 264/297.4; 264/297.9

[58] Field of Search ..... 264/228, 229, 264/278, 279, 279.1, 297.4, 297.9; 249/85, 90, 91, 94, 93, 96, 97, 120, 126, 133, 139, 163, 155

[56] References Cited

U.S. PATENT DOCUMENTS

| | | | |
|---|---|---|---|
| 2,234,663 | 3/1941 | Anderegg . | |
| 3,029,490 | 4/1962 | Middendorf | 264/228 |
| 3,202,394 | 8/1965 | Shoe | 264/228 |
| 3,907,951 | 9/1975 | Godley | 264/228 |
| 4,038,355 | 7/1977 | Bratchell | 264/228 |
| 4,273,740 | 6/1981 | Marchesi et al. | 264/228 |
| 4,421,710 | 12/1983 | Borcoman | 264/228 |
| 4,506,428 | 3/1985 | Gerhard | 264/228 |
| 4,526,739 | 7/1985 | Migliacci et al. | 264/228 |
| 4,738,605 | 4/1988 | Aerts et al. | 264/228 |
| 4,953,280 | 9/1990 | Kitzmiller | 264/228 |

*Primary Examiner*—Karen Aftergut

[57] ABSTRACT

A method and assembly (20) to form a cast concrete panel (21). The assembly (20) has end beams between which tendons (23) can pass. The beams need to be able to support tensioning of the tendons. Transversely extending form members (25) cooperate with form members (27) to enclose a space to receive concrete to form the panel (21). The tendons (23) pass through the space.

16 Claims, 9 Drawing Sheets

APPARATUS AND METHOD TO MANUFACTURE CAST PANELS

This is a continuation of PCT/AU96/00063, filed Feb. 9, 1996, now published as WO 96/25567.

TECHNICAL FIELD

The present invention relates to the batch-type manufacture of pre-tensioned concrete structural panels and more particularly, to improved methods and apparatus for manufacturing such pre-tensioned concrete structural panels in a plurality of different lengths and including the provision of apertures for windows, doors or other purposes in any position as required within the individual panels.

BACKGROUND OF THE INVENTION

Methods and apparatus employed to cast pre-tensioned concrete structural panels, are generally labour intensive and are not adapted to easily cast the panels with an aperture for a window, a door or other purpose. Still further, the formwork employed is only designed to manufacture a single sized panel. Still further, the decorative treatments of the panel faces are limited by the current methods of manufacture. Still further, the methods of prevention of water ingress from the external face to the internal panel face are inadequate or subject to poor on-site work practices. Still further, the methods of sealing openings in panels for doors or windows are limited by the life of the sealants used.

In the prior art, a batch-type process has been employed to more efficiently manufacture cast pre-tensioned concrete structural members in the form of panels, to be used, for example, as walls, floors or roofs in building construction. In a batch-type process, a long concrete slab or plank is poured and cured, and thereafter cut into a plurality of shorter length panels. Due to the relatively long curing time required, this batch-type process is more efficient than casting individual shorter panels because a large number of individual panels can be produced at substantially the same time. The length of the slab, before cutting into shorter individual panels, may be as much as 150 meters with the slab weighing 230,000 kg.

Generally, there are two batch-type methods employed for use in the manufacture of pre-tensioned concrete structural panels, either a fixed bed apparatus of the general type described in U.S. Pat. No. 3,217,375 of Kinnard, or a moving bed apparatus of the type described in U.S. Pat. No. 3,523,343 of Mitchell.

In the U.S. Pat. No. 3,217,375 of Kinnard, the pre-tensioned concrete structural member, including core openings therein, is produced on a long stationary casting bed by means of a hopper and roller units and a casting machine which travels the length of the bed. The completed member is then cured and subsequently cut into the desired lengths.

The U.S. Pat. No. 3,523,343 of Mitchell, describes a moving bed system wherein a manufacturing area contains sequentially used items of production equipment, suitably housed and located centrally between an elongated curing area and a similarly elongated unloading overrun area. A casting bed moves back and forth several times during each production cycle while the various operations of the manufacturing process are performed. The casting bed comprises a lengthy stress frame which is mounted on a track extending the full length of the facility and carries a moulding form in which the pre-tensioned concrete member is cast by equipment which remains stationary in the manufacturing area while the bed moves beneath it.

In the above described processes, the concrete slab is pre-tensioned by means of reinforcing strands or tendons longitudinally tensioned between the ends of the casting bed prior to the casting of concrete. After the concrete is cured, the ends of the tendons are released to transfer the stress to the concrete and then the slab is cut into a plurality of shorter individual panels. The pre-tensioned panels produced offer superior performance to panels made using conventional reinforcement, however, there are several limitations with these methods of manufacture, including the large size of the casting beds, apertures for window or door openings are not easily made, the cutting of the slab into a plurality of shorter individual panels produces large quantities of concrete sludge, the diamond cutting wheels employed to cut the concrete are expensive and wear rapidly, the individual panels produced by cutting the slab are not adapted for easy lifting from the casting bed, and connection of the individual panels to other building elements is not readily achieved.

OBJECT OF THE INVENTION

It is the object of the present invention to overcome or substantially ameliorate the above disadvantages.

SUMMARY OF THE INVENTION

A summary of a preferred embodiment of the present invention, an apparatus and method to manufacture pre-tensioned cast panels, that is an improvement over the prior art is disclosed herein, said apparatus and method including the known steps of:

providing a casting bed on which a concrete panel is cast;

providing a plurality of longitudinally extending reinforcing tendons that become incorporated within the concrete panel cast on a casting bed;

providing an apparatus and method to tension a plurality of longitudinally extending tendons between fixings located at opposite ends of a casting bed prior to the casting of concrete;

providing an apparatus and method for casting concrete within form members provided on a casting bed to produce a cast concrete panel;

providing an apparatus and method to smooth the surface of the concrete that is cast within form members provided on a casting bed to produce a cast concrete panel;

providing an apparatus and method to release a tensioned plurality of longitudinally extending tendons from fixings located at opposite ends of a casting bed after the concrete cast to form a panel has cured, thereby allowing the longitudinally extending plurality of tendons incorporated within the cast concrete panel to shorten and thereby pre-tension the cast concrete panel;

Wherein the improvement comprises the added steps of;

providing and positioning on the plurality of longitudinally extending tendons a first set of form members comprising at least two panel end form members, which panel end form members extend generally transversely of the plurality of longitudinally extending tendons with the plurality of longitudinally extending tendons passing therethrough and thereby the panel end form members can be positioned anywhere between the ends of a casting bed along the plurality of longitudinally extending tendons passing therethrough;

providing a second set of form members comprising at least two panel side form members, which panel side form members extend between the panel end form members, so that, the panel end form members and the panel side form members cooperate to create a first assembly, hereinafter referred to as a panel form assembly, which panel form assembly is employed to surround a volume, which panel form assembly can be positioned anywhere between the ends of a casting bed along the plurality of longitudinally extending tendons passing therethrough;

providing a plurality of tie-rods that extend generally transversely of the plurality of longitudinally extending tendons, which plurality of tie-rods are located in a predetermined arrangement within the panel form assembly, which plurality of tie-rods are employed for securement together of the panel side form members;

providing and positioning on a casting bed a third set of form members, comprising at least two panel end form supporters, which panel end form supporters extend generally transversely of the plurality of longitudinally extending tendons with the plurality of longitudinally extending tendons passing therethrough and thereby the panel end form members can be positioned anywhere between the ends of a casting bed along the plurality of longitudinally extending tendons passing therethrough, which panel end form supporters are located at opposite ends and outside of a panel form assembly adjacent to the panel end form members, which panel end form supporters support the panel end form members, which panel end form supporters locate a panel form assembly on a casting bed ready for the casting of concrete into the panel form assembly to produce a cast concrete panel.

The longitudinally extending tendons tensioned between the ends of the casting bed and passing through the panel end form members accurately locates the panel form assembly transverse of the casting bed and thereby enables the panel form assembly to be placed in any position on the casting bed along the tendons passing therethrough. The tie-rods in a periodic modular arrangement within a panel form assembly retain the panel side form members in position relative to the panel end form members. The panel end form supporters accurately locate a panel form assembly in any position between the ends of a casting bed, thereby allowing the self-supporting panel form assembly to be employed for casting pre-tensioned concrete panels on any casting bed that is adapted for the casting of pre-tensioned concrete panels.

In a further application of the present invention when it is desired to include an aperture, for a door or window, within the concrete panel cast within a panel form assembly, providing the additional steps of;

providing and positioning on the plurality of longitudinally extending tendons, inside the panel form members at opposite ends of a panel form assembly, a fourth set of form members comprising at least two aperture end form members, which aperture end form members extend generally transversely of the plurality of longitudinally extending tendons with the plurality of longitudinally extending tendons passing therethrough and thereby the aperture end form members can be positioned anywhere between the panel form members at opposite ends of the panel form assembly along the plurality of longitudinally extending tendons passing therethrough;

providing a fifth set of form members, inside the panel side members, comprising at least two aperture side form members, which aperture side form members extend between the aperture end form members, so that, the aperture end form members and the aperture side form members cooperate to create a second assembly, hereinafter referred to as an aperture form assembly, which aperture form assembly is employed to surround a volume of air to create a void within the concrete cast to form a panel within the panel form assembly, which aperture form assembly can be positioned anywhere between the panel end form members at opposite ends of a panel form assembly along the plurality of longitudinally extending tendons passing therethrough;

providing a plurality of tie-rods that extend generally transversely of the plurality of longitudinally extending tendons, which plurality of tie-rods are located in a predetermined arrangement within the panel form assembly between the panel side form members and the aperture side form members, which plurality of tie-rods are employed for securement together of the panel side form members and aperture side form members;

providing a sixth set of form members within the aperture form assembly comprising of an aperture skeleton frame, which aperture skeleton frame supports the aperture end form members at opposite ends of the aperture form assembly, which aperture skeleton frame is employed for securement together of the aperture side form members within the aperture form assembly.

The longitudinally extending tendons tensioned between the ends of the casting bed and passing through the panel form assembly and the aperture end form members accurately locates the aperture form assembly transverse of the casting bed and thereby enables the aperture form assembly to be accurately placed in any position on the casting bed within the panel form assembly between the panel end form members at opposite ends of the panel form assembly along the tendons passing therethrough. The tie-rods in a predetermined arrangement within the panel form assembly retain the aperture side form members in position relative to the panel side form members. The aperture side form members in cooperation with the aperture end form members determine the size and location of the aperture form assembly and thereby the size and location of the aperture within the concrete panel cast within the panel form assembly.

Providing a plurality of tie-rods in a predetermined arrangement that extend generally transversely of a plurality of longitudinally extending tendons tensioned between the ends of a casting bed, which plurality of tie-rods in a predetermined arrangement, in a panel form assembly, is employed for securement together of the panel side form members, which plurality of tie-rods in a predetermined arrangement, when an aperture form assembly is employed within a panel form assembly, provide securement together of the aperture form assembly within the panel form assembly, which plurality of tie-rods in a predetermined arrangement is employed for securement of lifting apparatus to aid in lifting the panel cast within a panel form assembly, which plurality of tie-rods in a predetermined arrangement is employed for securement of fasteners to connect the panel cast within a panel form assembly to other building elements.

Providing and positioning on a casting bed, at least two panel end form supporters, which panel end form supporters extend generally transversely of a plurality of longitudinally extending tendons with the plurality of longitudinally extending tendons passing therethrough, which panel end form supporters are located at opposite ends and outside of a panel form assembly adjacent to the panel end form members, which panel end form supporters locate a panel form assembly on the casting bed and supports the panel end form members, which panel end form supporter is fabricated as a mirror image around a centre line so that a plurality of panel form assemblies can be banked on the casting bed and hence a plurality of panels are cast in a continuous batch-type operation, which panel end form supporter creates a separation between the panels cast within the banked panel form assemblies and thereby enables the tendons to be cut.

Providing a casting bed that has an upwards facing, generally planar surface to receive a panel form assembly so that concrete can be cast within the panel form assembly to produce a cast concrete panel, which casting bed has fixings located at opposite ends of the casting bed that are employed to tension a plurality of longitudinally extending tendons prior to the casting of concrete, which casting bed is supported on legs located only at opposite ends of the casting bed to create a clear space under the casting bed between the legs, which casting bed is able to be mounted on or by another casting bed, thereby enabling a plurality of casting beds to be stacked vertically.

BRIEF DESCRIPTION OF THE DRAWINGS

A preferred form of the present invention will now be described by way of example with reference to the accompanying drawings wherein.

DESCRIPTION OF THE PREFERRED EMBODIMENT

Figure 1:
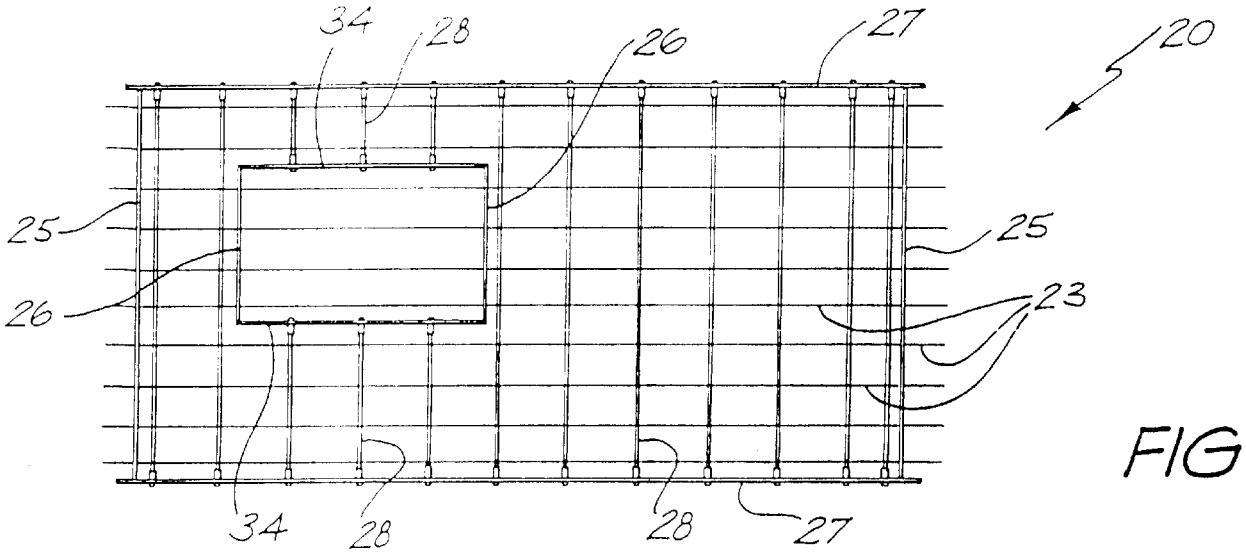
FIG. 1 is a schematic top plan view of a panel form assembly wherein, an aperture form assembly is located by a plurality of tie-rods in a predetermined arrangement within a panel form assembly, showing the plurality of longitudinally extending tendons passing therethrough, the aperture skeleton frame has been omitted for clarity.

A preferred form of the present invention, an apparatus and method to manufacture cast panels, that is an improvement over the prior art disclosed in U.S. Pat. No. 3,217,375 of Kinnard and U.S. Pat. No. 3,523,343 of Mitchell, will now be described by way of example with reference to the accompanying drawings, said method including the steps of:

Providing a plurality of longitudinally extending reinforcing tendons that are tensioned between the ends of a casting bed prior to the casting of concrete and releasing the tension applied to the ends of the longitudinally extending tendons when the concrete used to cast the panel has cured, thereby transferring the stress to the concrete used to cast the panel and thereby pre-tensioning the panel. This is a well-known technique in the art and is adopted for employ in this method.

Providing a casting bed 50, schematically depicted in the, accompanying drawings in FIGS. 19 to 22 and in this embodiment the casting bed 50 includes a base frame 51 consisting of a generally planar and horizontal base 52 with an upward facing surface on which panels are cast, supported on legs 53 that raise the casting bed to create a clear space under the casting bed between the legs 53. Extending between the support legs 53 are rods 54 to aid in retaining the support legs 53 in the correct position. More particularly, the rods 54 would be tensioned to ameliorate any problems associated with the base frame 51 sagging.

Figure 19:
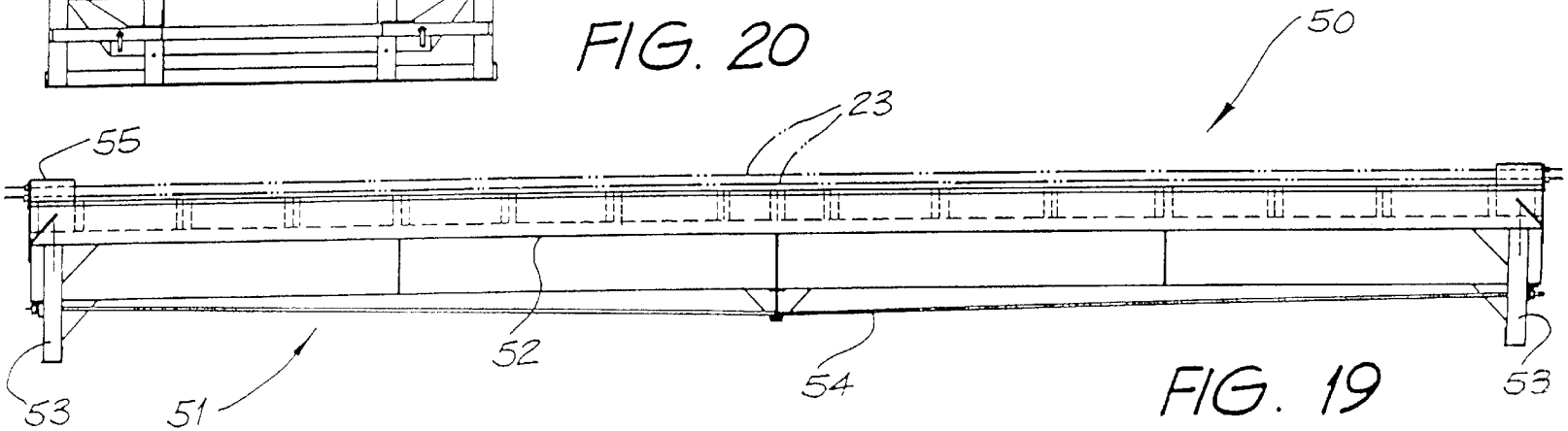
FIG. 19 is a schematic side elevation of a casting bed showing the plurality of longitudinally extending tendons, the bed support assemblies and support legs that raise the casting bed to create a clear space under the casting bed between the legs.
Figure 21:
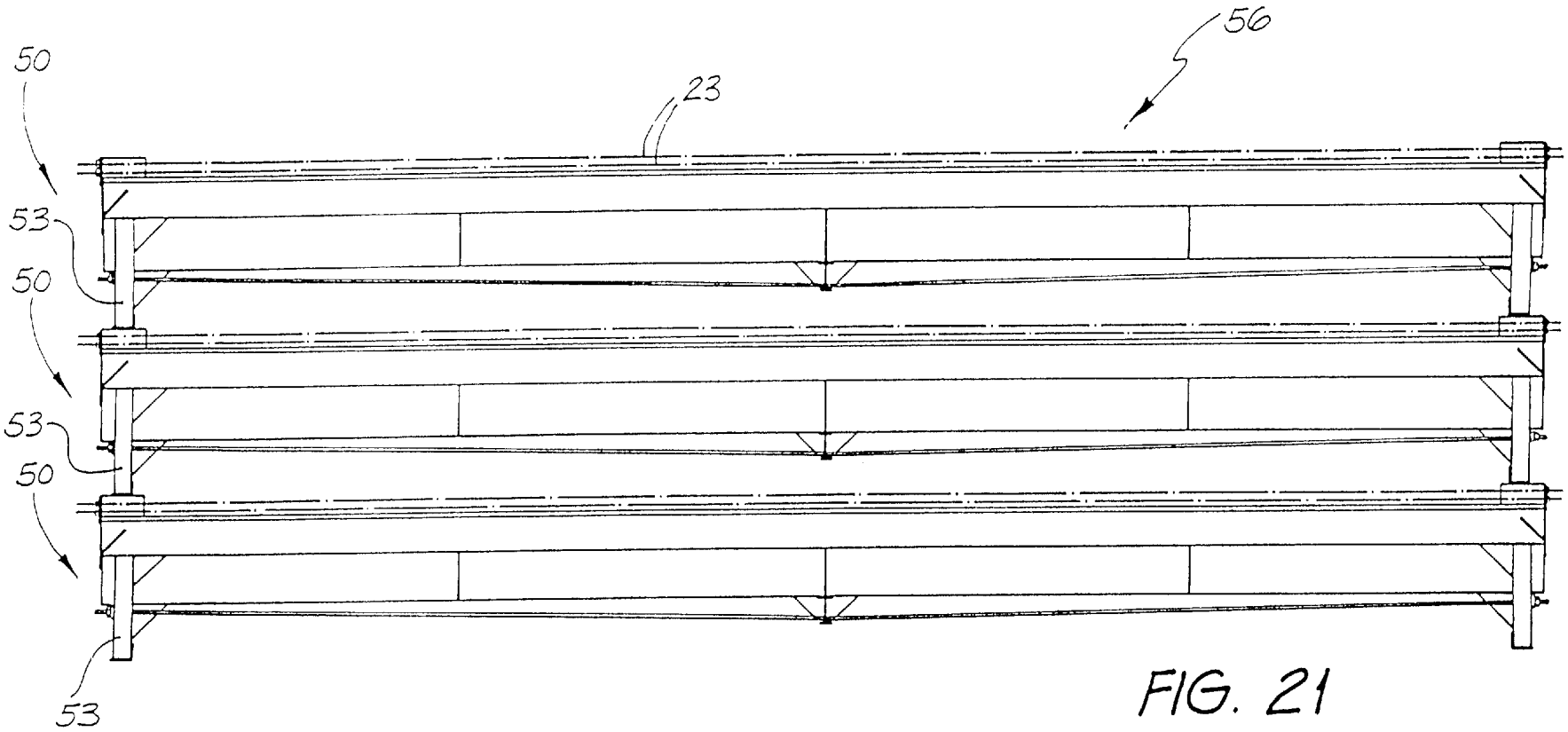
FIG. 21 is a schematic side elevation of a stack of casting beds shown in FIG. 19, showing the plurality of longitudinally extending tendons, the bed support assemblies and support legs cooperating to enable the beds to be stacked with a clear space between the casting beds.
Figure 22:
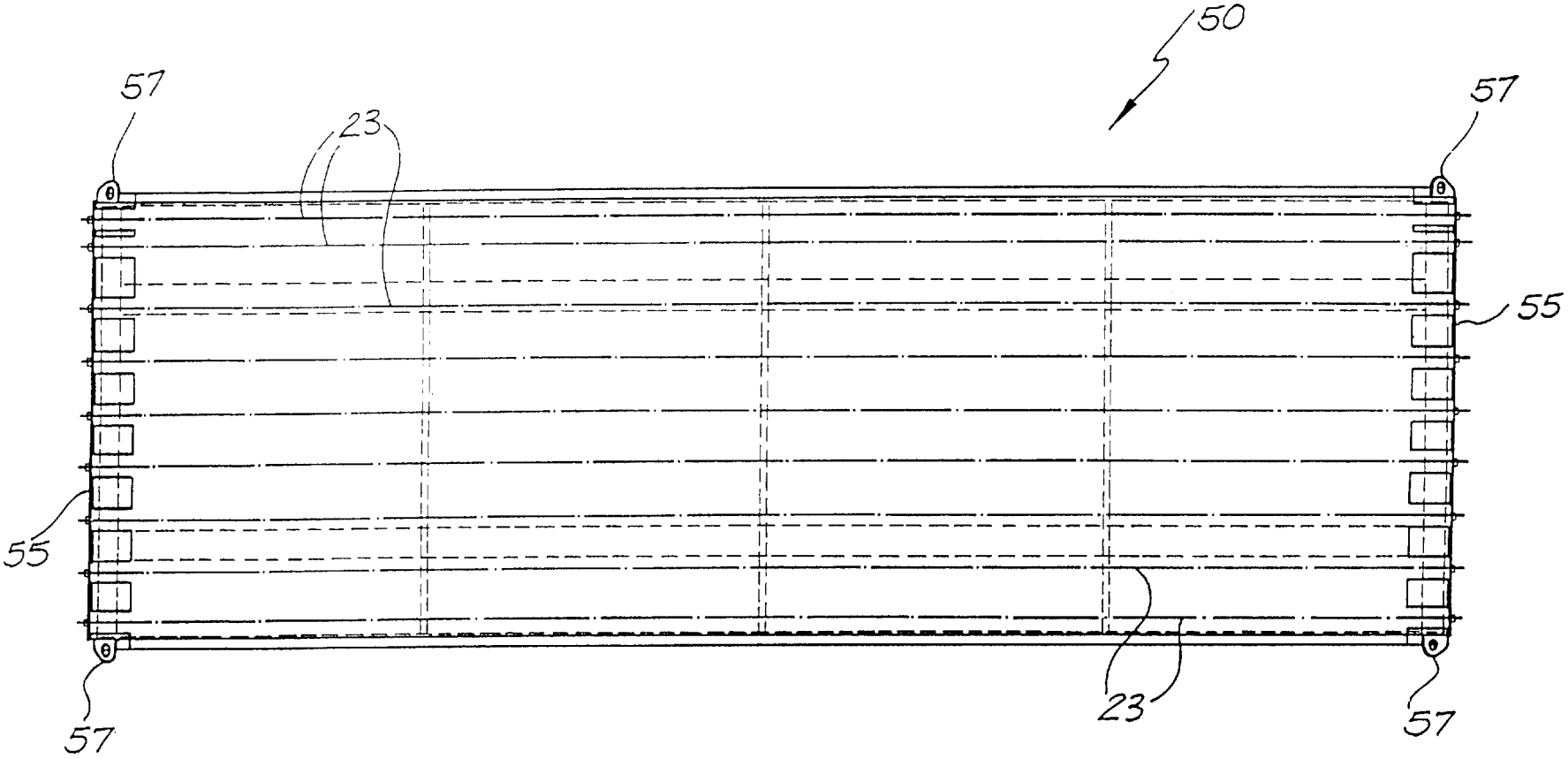
FIG. 22 is a schematic top plan view of the casting bed of FIG. 19 showing the plurality of longitudinally extending tendons and the bed support assemblies with the tendons passing therethrough.

Directly above the support legs 53 on the upward facing surface of the generally horizontal base 52, is a plurality of bed support assemblies 55, as shown in FIG. 19, through which a plurality of longitudinally extending tendons 23 pass, as best seen in FIG. 22. The plurality of bed support assemblies 55 cooperate with the support legs 53 to provide a mounting for the next adjacent above bed 50 of the stack 56 of FIG. 21. The stack 56 of FIG. 21 is a stack of beds 50. As can be noted, the support legs 53 rest on the plurality of bed support assemblies 55 of the next below bed 50 with a clear space between the casting beds.

Each bed 50 would be provided with a series of eyelets 57 to enable the bed(s) 50 to be lifted by crane or other device.

By employing the bed 50 and having it adapted to be stacked 56, a series of panels 21 can be simultaneously cast and/or curing, with the size of the area needed to stand the casting beds also being reduced.

Providing a panel form assembly 20, as schematically depicted in FIG. 1, comprising end form members 25, side form members 27 and a plurality of tie-rod 28 in a predetermined arrangement with longitudinally extending tendons 23 passing therethrough, the end form members 25, side form members 27 and a plurality of tie-rod 28 in predetermined arrangement cooperate to enclose a volume into which concrete is cast to form a panel 21.

Figure 10:
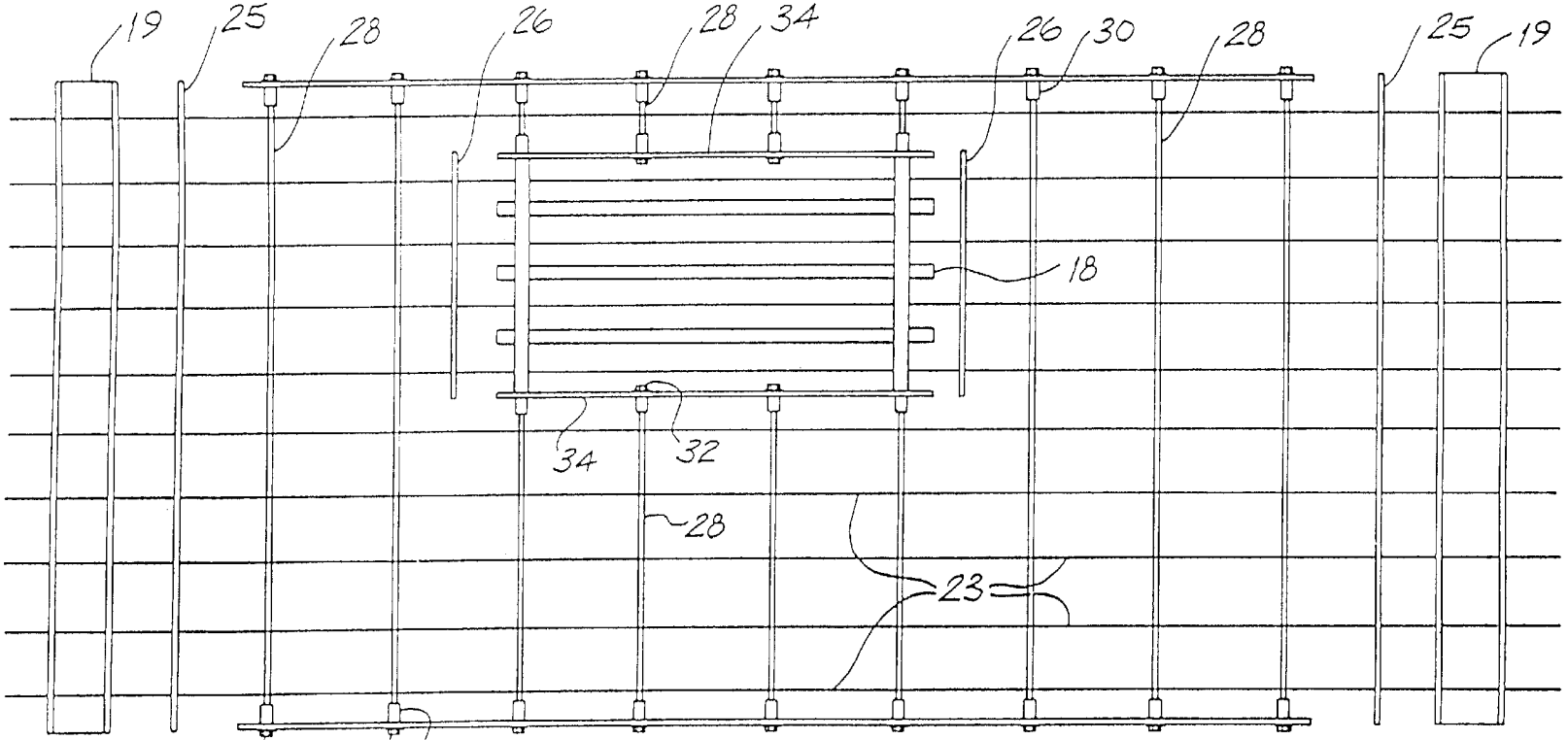
FIG. 10 is schematic top plan view of the panel form assembly and aperture form assembly, including the aperture skeleton frame omitted from FIGS. 1 and 2 and showing the individual components in more detail.

Providing within the panel form assembly 20, an aperture skeleton frame 18, aperture end form members 26, aperture side form members 34, and a plurality of tie-rod 28 in a predetermined arrangement, which members cooperate to create an aperture form assembly to make a void in the material cast to form the panel 21, where an aperture for a window, a door or other purpose is required within the panel 21, as best seen in FIG. 10. The aperture form assembly can be placed, prior to the placement of the plurality of tie-rod 28 in a periodic modular arrangement, in any position longitudinally within the panel form assembly 20 along the longitudinally extending tendons 23 passing through the aperture form member 26 and is thereby accurately positioned transversely of the longitudinally extending tendons 23 by the tendons 23 passing therethrough.

Figure 2:
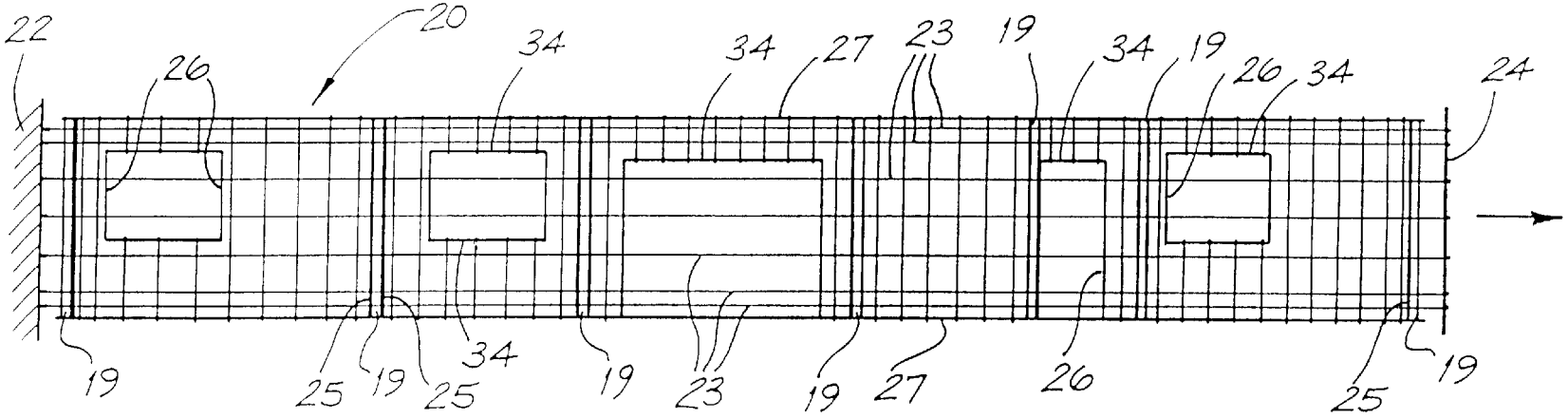
FIG. 2 is a schematic top plan view of a banked plurality of the panel form assemblies of FIG. 1, showing the panel end form supporters separating the panel form assemblies and the variation in size and position of the panel form assemblies and aperture form assemblies, as can be noted the assemblies are able to be positioned anywhere along the plurality of longitudinally extending tendons, the aperture skeleton frame depicted in FIG. 10 has been omitted for clarity; Also shown is the plurality of longitudinally extending tendons with tension applied between the ends of the bed and passing continuously through each assembly.

A plurality of panel form assemblies 20 of FIGS. 1 and 10 are arranged on the casting bed 50 in a "banked" arrangement as best seen in FIG. 2, with the longitudinally extending tendons 23 passing therethrough, as can be noted, each panel form assembly 20 can be positioned anywhere along the longitudinally extending tendons 23. A panel end form supporter 19, which has apertures for the longitudinally extending tendons 23 to pass therethrough, is employed at each end of each panel form assembly 20. The panel end form supporter 19 creates a separation between each panel 21 where the longitudinally extending tendons 23 will be cut when the concrete is cured and the tension has been removed from the ends of the longitudinally extending tendons 23. When the various form members are placed in position, the longitudinally extending tendons 23 are fully tensioned thereby supporting and aligning the plurality of panel form assemblies 20 in the "banked" configuration as best seen in FIG. 2. Thereafter, concrete or other material is delivered to the various spaces within the plurality of panel form assemblies 20 so that panels 21 are cast in a continuous batch-type operation.

The individual components of panel form assembly 20 perform various functions that are essential to the overall performance of the panel form assembly 20 and more specifically to the plurality of panel form assemblies 20 in the "banked" configuration as best seen in FIG. 2.

The plurality of longitudinally extending tendons 23, when tensioned, are employed to act as a guide, anywhere along the length of which, the panel end form supporter 19, the end form member 25 and aperture end form member 26 can be positioned transversely, thereby allowing the panel form assembly 20 to be positioned anywhere along the length of the longitudinally extending tendons 23 and the aperture form assembly to be positioned anywhere within the panel form assembly 20 along the longitudinally extending tendons 23.

This operation is similar to the operation of an abacus, where counters slide along wires and as in this case form members are moveable along tendons.

Figure 11:
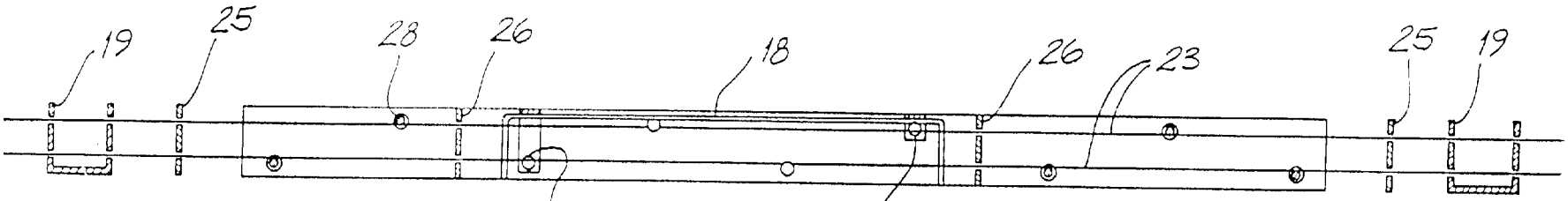
FIG. 11 is a schematic sectioned view of FIGS. 1, 2 and 10 showing the individual components of the panel form assembly and aperture form assembly in more detail.
Figure 12:
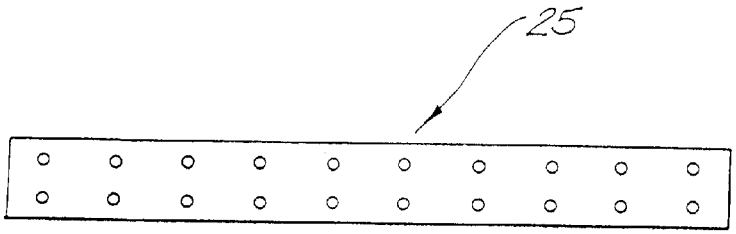
FIG. 12 is a schematic side elevation of the end form member through which the plurality of longitudinally extending tendons pass in FIGS. 1, 2, 3, 5, 10 and 11.

FIG. 12 is a side elevation of the end form member 25 showing the plurality of apertures through which the plurality of longitudinally extending tendons 23 pass. This arrangement accurately positions the end form members 25 transversely of the longitudinally extending tendons 23. The end form member 25 is employed to form the end of the individual panel 21 cast in panel form assembly 20 and the length of the end form member 25 defines the width of the individual panel 21 cast in panel form assembly 20, this is best seen in FIGS. 1, 2 and 10. The height of the end form member 25 perpendicular to the casting surface defines the thickness of the panel 21 cast in panel form assembly 20, this is best seen in FIGS. 3, 4, 5, 9 and 11.

Figure 13:
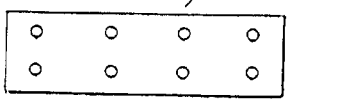
FIG. 13 is a schematic side elevation of the aperture end form member through which the tendons pass in FIGS. 1, 2, 10 and 11.

Aperture end form member 26 is generally similar to the end form member 25 and can be positioned anywhere along the longitudinally extending tendons 23 within the panel form assembly 20. The end form member 25 limits the travel of the aperture end form member 26 to within the panel form assembly 20. FIG. 13 is a side elevation of the aperture end form member 26 showing the plurality of apertures through which the longitudinally extending tendons 23 pass and which apertures are employed to accurately position the aperture end form member 26 transversely of the longitudinally extending tendons 23, this is best seen in FIGS. 1, 2 and 10. The aperture end form member 26 is employed to form and define the length of the ends of the aperture for a window, a door or other purpose, in the panel 21 cast in panel form assembly 20, this is best seen in FIGS. 1, 2 and 10. The thickness of panel 21, cast in panel form assembly 20, is defined by the height of the aperture end form member 26 perpendicular to the casting base, this is best seen in FIG. 11.

The panel end form supporter 19 is employed at each end of panel form assembly 20 to provide support and accurately position transversely of the longitudinally extending tendons 23, the end form member 25 in panel form assembly 20 while concrete is cast to form the panel 21, this is best seen in FIGS. 2, 3, 5, 9, 10 and 11. The panel end form supporter 19, is fabricated as a mirror image around a centre line to enable a plurality of panel form assembly 20 to be "banked" on a casting bed, as shown in FIG. 2.

Figure 3:
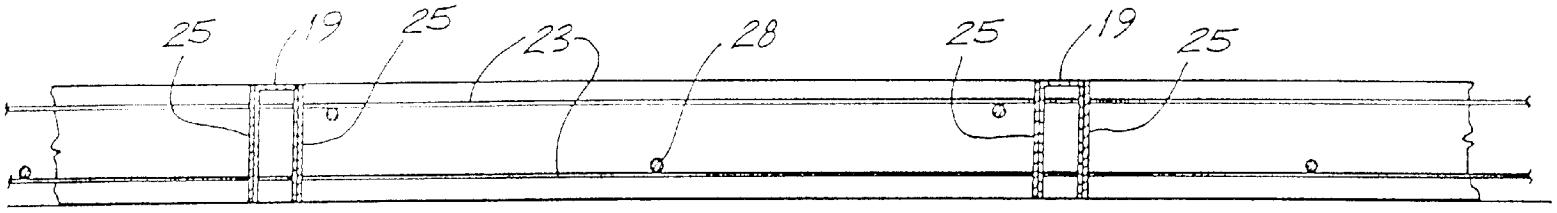
FIG. 3 is a schematic sectioned side elevation through a panel form assembly of FIGS. 1 and 2 showing the plurality of horizontally extending tendons passing continuously through the panel end form members and panel end form supporters.
Figure 4:
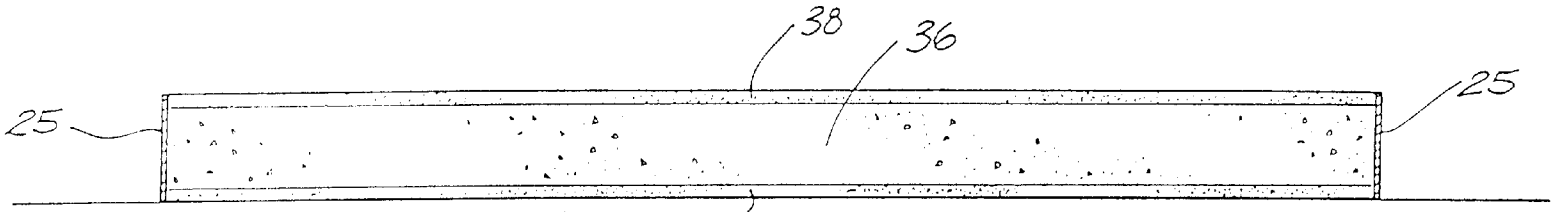
FIG. 4 is a schematic sectioned side elevation of a panel formed in one of the assemblies of FIGS. 1 and 2 showing layers of differing material used to cast the panel.
Figure 6:
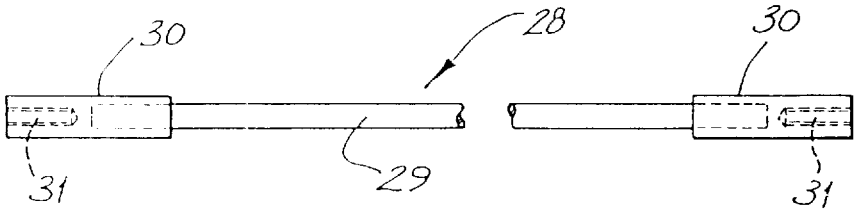
FIG. 6 is a schematic side elevation of a tie-rod employed in the assemblies of FIGS. 1, 2, 3, 8, 10 and 11.
Figure 7:
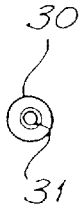
FIG. 7 is a schematic end elevation of a collet employed in the tie-rod of FIG. 6.
Figure 8:
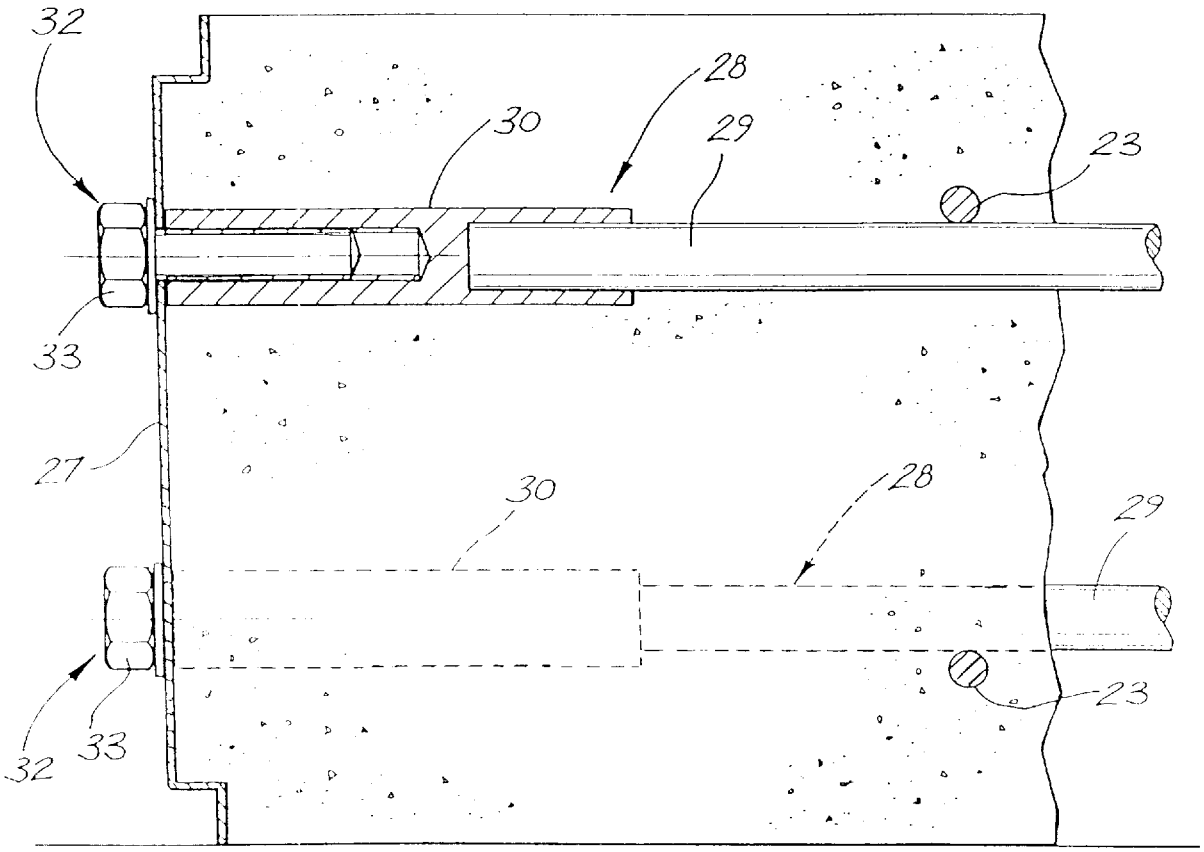
FIG. 8 is a schematic sectioned end elevation of a portion of a panel cast with the panel form assembly of FIGS. 1 and 2 showing the tie-rod of FIG. 6 connected to and supporting the side form member by a bolt.
Figure 9:
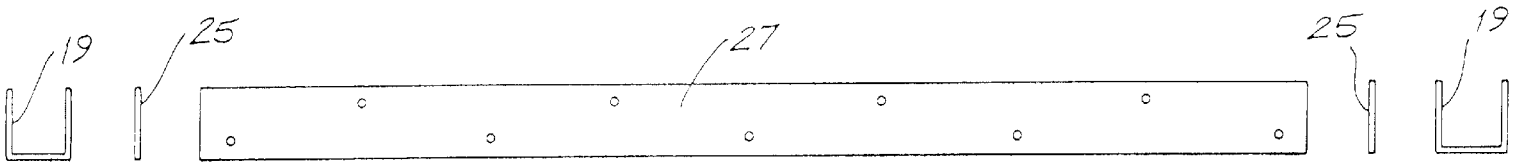
FIG. 9 is a schematic side elevation of the side form member, showing the apertures through which bolts pass to connect with the tie-rod of FIG. 6, also shown are end form members and panel end form supporter of FIGS. 1, 2, 3, 10 and 11, showing the components in more detail.

The tie-rod 28 shown in FIG. 6 include deformed reinforcing bar or other material 29, to both ends of which there is fixed a collet 30 with a threaded passage 31 within that enables a bolt 32 to engage within the passage 31. FIG. 7 is an end elevation of the collet showing the threaded passage 31 that enables a bolt 32 to engage within the passage 31 of tie-rod 28, as best seen in FIGS. 6 and 8. The length of the deformed reinforcing bar 29 is varied to suit the width of the panel 21 cast within panel form assembly 20 and/or as needed to define the distance between the aperture side form member 34 and the side form member 27 in panel form assembly 20. Generally, bolts 32 pass through aligned apertures in the side form member 27, of panel form assembly 20, to engage within the passage 31 of tie-rod 28, thereby the side form member 27 is aligned, connected and supported from within panel form assembly 20 by a plurality of tie-rod 28 in a periodic modular arrangement, this is best seen in FIGS. 1, 2, 8 and 10 and the aligned apertures in the side form member 27 are best seen in FIGS. 3, 9 and 11.

The aperture form assembly, within the panel form assembly 20, consists of aperture side form members 34, aperture end form members 26 and the aperture skeleton frame 18, which aperture form assembly is aligned with and connected to the side form members 27, of panel form assembly 20, by bolts 32 passing through aligned apertures in the members and engaging within the passage 31 of the plurality of tie-rod 28 in a predetermined arrangement and also, thereby accurately positioning longitudinally the aperture within the panel form assembly 20, this is best seen in FIGS. 1, 2, 10 and 11.

When the material used to cast the panel 21 in panel assembly 20, has cured, the form members have been removed and the tendons 23 cut, bolts 32 engaging within the passage 31 of the tie-rod 28 in a periodic modular arrangement are employed to attach lifting apparatus to the panel 21 and/or to connect the panel 21 to other building elements.

Two side form members 27 cooperate with two end form members 25, in panel form assembly 20, to surround a volume into which concrete or other material is cast to form a panel 21, this is best seen in FIGS. 1, 2 and 10. The perpendicular height, above the casting surface, of side form member 27 defines the thickness of the panel 21 cast in panel form assembly 20, this is best seen in FIG. 8. The length of side form member 27 defines the length of the panel 21 cast in panel form assembly 20, this is best seen in FIGS. 1, 9, 10 and 11.

At least one but normally two aperture side form members 34 cooperate with two aperture end form members 26 and the aperture skeleton frame 18 to form an aperture form assembly that is employed to surround a volume of air to create a void in the material cast in panel form assembly 20, thereby creating an aperture within the panel 21 for a window, a door or other purpose. The aperture end form member 26 has a plurality of apertures through which the plurality of longitudinally extending tendons 23 pass, thereby enabling the aperture form assembly to be positioned anywhere longitudinally within the panel form assembly 20 and accurately positioned transversely of the longitudinally extending tendons 23.

Figure 18:
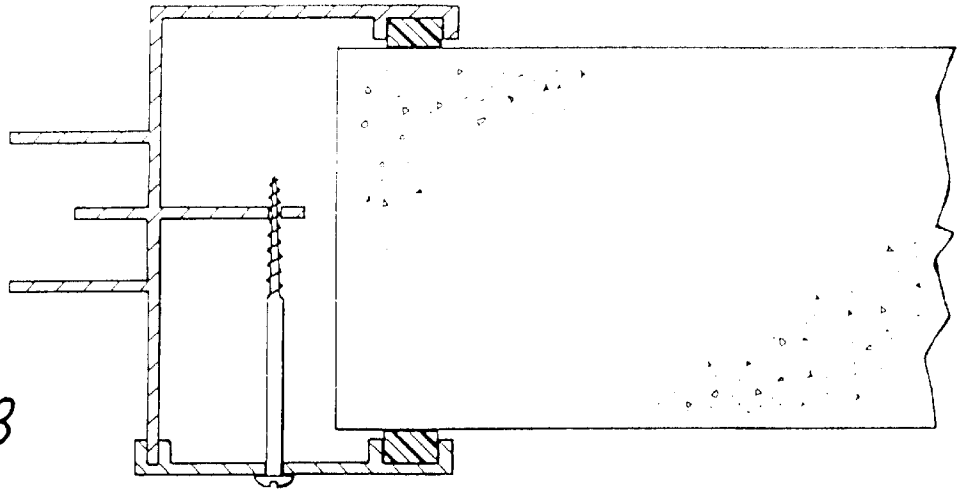
FIG. 18 is a schematic section end elevation showing the hinged compression sealing moulding used to seal apertures in the panels cast using the assemblies of FIG. 2.
Figure 20:
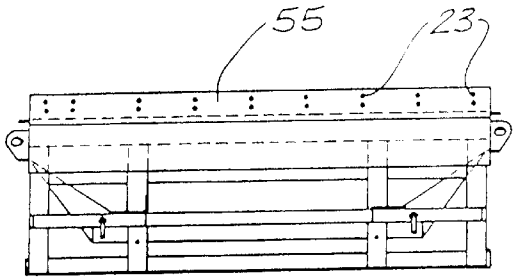
FIG. 20 is a schematic end elevation of the bed of FIG. 19 showing the plurality of longitudinally extending tendons, bed support assemblies and support legs.

Providing a compression sealing moulding to the boundaries of apertures made within the individual panel for a window, a door or other purpose, which compression sealing moulding is of generally hinged C-shaped, cross section so as to have a pair of legs joined by a base and screw, which compression sealing moulding is located adjacent to the boundary of the aperture in the panel so that a portion of the panel is located between the legs of the compression sealing moulding and the movement of the legs into conjunction by the action of the screw, compresses the moulding into sealing contact with the panel, as best seen in FIG. 18. By using the section of moulding shown in FIG. 18, a waterproof seal is created at all apertures in the panel 21.

Figure 5:
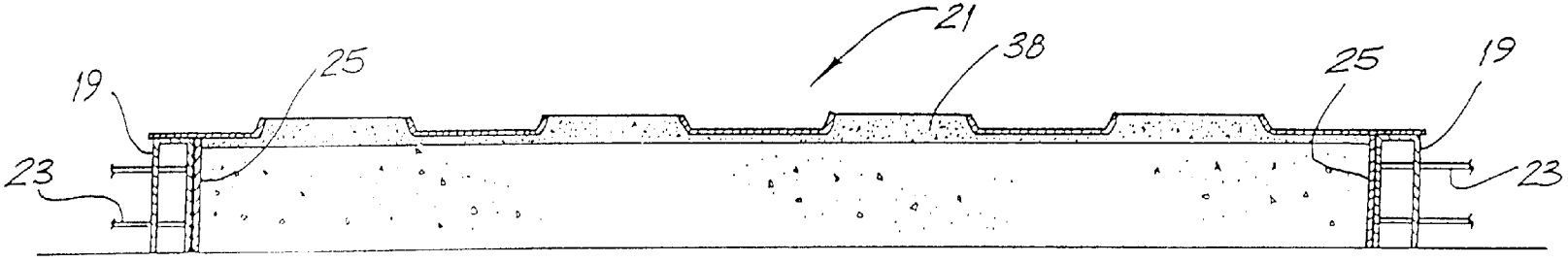
FIG. 5 is a schematic sectioned side elevation of a panel formed in one of the panel form assemblies of FIGS. 1 and 2, showing how the panel end form supporters are employed to support the panel end form members and also provide support for a reverse mould form.

Providing a reverse mould to the upper face of the panel, which reverse mould volume is filled with grout to create a raised relief moulding on the surface of the panel, as shown in FIG. 5.

Figure 14:
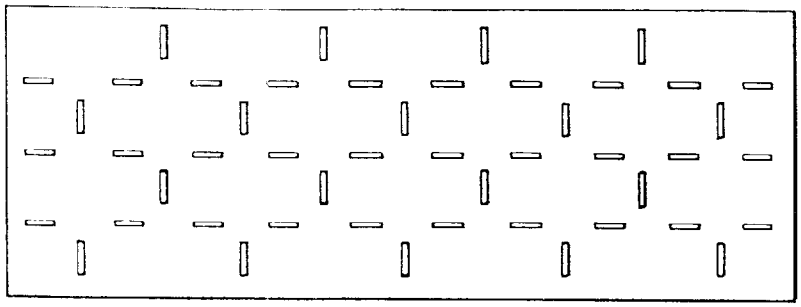
FIG. 14 is a schematic plan view of a jig for holding 10 mm thick brick wafers in a stretcher bond pattern prior to embedding in the panels cast using the assemblies of FIG. 2.
Figure 15:
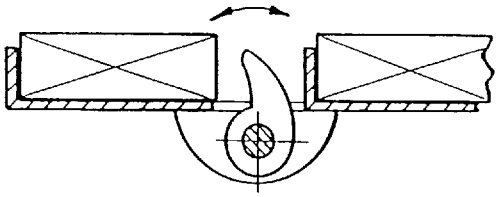
FIG. 15 is a schematic section view of FIG. 14 showing how the cam grips and releases the brick wafers for embedding in panels cast using the assemblies of FIG. 2.
Figure 16:
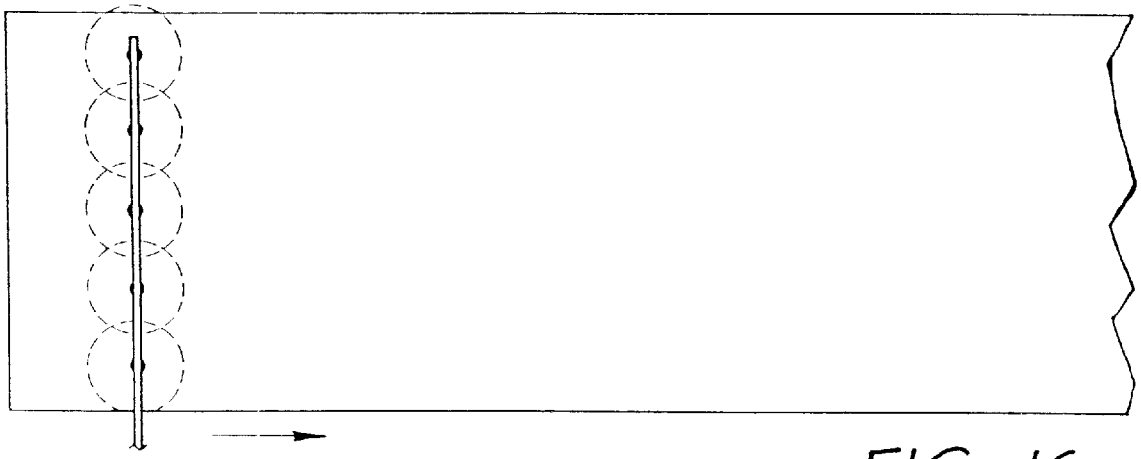
FIG. 16 is a schematic overhead view of a travelling plurality of spray guns with overlapping spray patterns for the application of a uniform coating of decorative or waterproof finish to the panels cast using the assemblies of FIG. 2.
Figure 17:
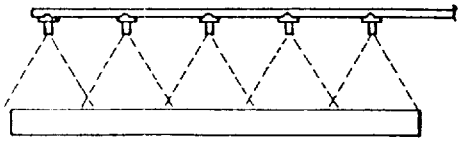
FIG. 17 is a schematic end view of the overlapping spray pattern of FIG. 16.

Providing a decorative facing jig, FIG. 14, to hold by employing a loading cam, located in the apertures shown in FIG. 14, thin wafers of brick or other material, as best seen in FIG. 15, which facing jig holds the thin wafers in position in a decorative pattern for application to the upper face of the panel 21, which jig is loaded with the decorative material prior to the panel 21 being cast, which jig is inverted in position over the upper face of the panel 21 and the decorative facing material is then released from the jig by releasing the loading cam, FIG. 14, which facing material is then pressed into contact with the upper face of the panel 21.

What is claimed is:

1. In a method for manufacturing a plurality of pre-tensioned cast concrete panels, the method comprising the known steps of:

providing a casting bed on which a concrete panel is cast;

providing a plurality of longitudinally extending reinforcing tendons that become incorporated within the concrete panel cast on the casting bed;

providing an apparatus and method to tension the plurality of longitudinally extending tendons between fixings located at opposite ends of the casting bed prior to the casting of concrete;

providing an apparatus and method for casting concrete within form members provided on the casting bed to produce the cast concrete panel;

providing an apparatus and method to smooth a surface of the concrete that is cast within the form members provided on the casting bed to produce the cast concrete panel having a smooth surface; providing an apparatus and method to release the tensioned plurality of longitudinally extending tendons from the fixings located at the opposite ends of the casting bed after the concrete cast to form the panel has cured, thereby allowing the longitudinally extending plurality of tendons incorporated within the cast concrete panel to shorten and thereby pre-tension the cast concrete panel;

wherein the improvement comprises the added steps of:

providing and positioning on the plurality of longitudinally extending tendons a first set of form members comprising at least two panel end form members, which panel end form members extend generally transversely of the plurality of longitudinally extending tendons with the plurality of longitudinally extending tendons passing therethrough and thereby the panel end form members are positioned anywhere between the opposite ends of the casting bed along the plurality of longitudinally extending tendons passing therethrough;

providing a second set of form members comprising at least two panel side form members, which panel side form members extend between the panel end form members, so that, the panel end form members and the panel side form members cooperate to create a first assembly, hereinafter referred to as a panel form assembly, which panel form assembly surrounds a volume, and which panel form assembly is positioned anywhere between the ends of the casting bed along the plurality of longitudinally extending tendons passing therethrough;

providing a plurality of tie-rods that extend generally transversely of the plurality of longitudinally extending tendons, which plurality of tie-rods are located in a predetermined arrangement within the panel form assembly, and which plurality of tie-rods secure together the panel side form members;

providing and positioning on the casting bed a third set of form members, comprising at least two panel end form supporters, which panel end form supporters extend generally transversely of the plurality of longitudinally extending tendons with the plurality of longitudinally extending tendons passing therethrough and thereby the panel end form members are positioned anywhere between the ends of the casting bed along the plurality of longitudinally extending tendons passing therethrough, which panel end form supporters are located at opposite ends and outside of the panel form assembly adjacent to the panel end form members, which panel end form supporters support the panel end form members, and which panel end form supporters locate the panel form assembly on the casting bed during the casting of the concrete into the panel form assembly to produce the cast concrete panel.

2. In the method for manufacturing a plurality of pre-tensioned cast concrete panels as claimed in claim 1, further including formation of an aperture, for a door or window, within the concrete panel cast within the panel form assembly, further comprising the steps of:

providing and positioning on the plurality of longitudinally extending tendons, inside the panel end form members at opposite ends of the panel form assembly, a fourth set of form members comprising at least two aperture end form members, which aperture end form members extend generally transversely of the plurality of longitudinally extending tendons with the plurality of longitudinally extending tendons passing therethrough and thereby the aperture end form members are positioned anywhere between the panel end form members at opposite ends of the panel form assembly along the plurality of longitudinally extending tendons passing therethrough;

providing a fifth set of form members, inside the panel side form members, comprising at least two aperture side form members, which aperture side form members extend between the aperture end form members, so that, the aperture end form members and the aperture side form members cooperate to create a second assembly, hereinafter referred to as an aperture form assembly, which aperture form assembly surrounds a volume of air to create a void within the concrete cast to form the panel within the panel form assembly, which aperture form assembly is positioned anywhere between the panel end form members at opposite ends of the panel form assembly along the plurality of longitudinally extending tendons passing therethrough;

providing a plurality of tie-rods that extend generally transversely of the plurality of longitudinally extending tendons, which plurality of tie-rods are located in a predetermined arrangement within the panel form assembly between the panel side form members and the aperture side form members, which plurality of tie-rods secure together the panel side form members and the aperture side form members;

providing a sixth set of form members within the aperture form assembly comprising of an aperture skeleton frame, which aperture skeleton frame supports the aperture end form members at opposite ends of the aperture form assembly, and which aperture skeleton frame secures together the aperture side form members within the aperture form assembly.

3. In the method for manufacturing a plurality of pre-tensioned cast concrete panels as claimed in claim 1, also including the step of:

providing the plurality of tie-rods in the predetermined arrangement to extend generally transversely of the plurality of longitudinally extending tendons tensioned between the ends of the casting bed, such that the plurality of tie-rods in the predetermined arrangement, in the panel form assembly, secures together the panel side form members, which plurality of tie-rods in the predetermined arrangement is employed for securement of lifting apparatus to aid in lifting the panel cast within the panel form assembly, and which plurality of tie-rods in the predetermined arrangement is employed for securement of fasteners to connect the panel cast within the panel form assembly to other building elements.

4. In the method for manufacturing a plurality of pre-tensioned cast concrete panels as claimed in claim 2, also including the step of:

providing the plurality of tie-rods in the predetermined arrangement to extend generally transversely of the plurality of longitudinally extending tendons tensioned between the ends of a casting bed, such that the plurality of tie-rods in the predetermined arrangement, in the panel form assembly, is employed for securement together of the panel side form members, which plurality of tie-rods in the predetermined arrangement, when the aperture form assembly is employed within the panel form assembly, provide securement together of the aperture form assembly within the panel form assembly, which plurality of tie-rods in the predetermined arrangement is employed for securement of lifting apparatus to aid in lifting the panel cast within the panel form assembly, and which plurality of tie-rods in the predetermined arrangement is employed for securement of fasteners to connect the panel cast within the panel form assembly to other building elements.

5. In the method for manufacturing a plurality of pre-tensioned cast concrete panels as claimed in claim 1, also including the step of:

providing and positioning on the casting bed, the at least two panel end form supporters, which panel end form supporters extend generally transversely of the plurality of longitudinally extending tendons with the plurality of longitudinally extending tendons passing therethrough, such that the panel end form supporters are located at opposite ends and outside of the panel form assembly adjacent to the panel end form members, which panel end form supporters locate the panel form assembly on the casting bed and support the panel end form members, which panel end form supporters are each fabricated as a mirror image around a centre line so that a plurality of panel form assemblies are banked on the casting bed and hence the plurality of panels are cast in a continuous batch operation, and which panel end form supporters create separation between the panels cast within the banked panel form assemblies and thereby enable the plurality of longitudinally extending tendons to be cut.

6. In the method for manufacturing a plurality of pre-tensioned cast concrete panels as claimed in claim 2, also including the step of:

providing and positioning on the casting bed, the at least two panel end form supporters, which panel end form supporters extend generally transversely of the plurality of longitudinally extending tendons with the plurality of longitudinally extending tendons passing therethrough, such that the panel end form supporters are located at opposite ends and outside of the panel form assembly adjacent to the panel end form members, which panel end form supporters locate the panel form assembly on the casting bed and support the panel end form members, which panel end form supporter are each fabricated as a mirror image around a centre line so that a plurality of panel form assemblies are banked on the casting bed and hence the plurality of panels are cast in a continuous batch operation, and which panel end form supporters create separation between the panels cast within the banked panel form assemblies and thereby enable the plurality of longitudinally extending tendons to be cut.

7. In the method for manufacturing a plurality of pre-tensioned cast concrete panels as claimed in claim 1, also including the step of:

providing the casting bed with an upwards facing, generally planar surface to receive the panel form assembly so that the concrete cast within the panel form assembly produces the cast concrete panel, which casting bed has fixings located at opposite ends of the casting bed for tensioning the plurality of longitudinally extending tendons prior to the casting of the concrete, which casting bed is supported on legs located only at opposite ends of the casting bed, which legs raise the casting bed to create a clear space under the casting bed between the legs, and which casting bed is mountable on or by another casting bed, thereby enabling vertical stacking of a plurality of the casting beds.

8. In the method for manufacturing a plurality of pre-tensioned cast concrete panels as claimed in claim 2, also including the step of:

providing the casting bed with an upwards facing, generally planar surface to receive the panel form assembly so that the concrete cast within the panel form assembly produces the cast concrete panel, which casting bed has fixings located at opposite ends of the casting bed for tensioning the plurality of longitudinally extending tendons prior to the casting of the concrete, which casting bed is supported on legs located only at opposite ends of the casting bed, which legs raise the casting bed to create a clear space under the casting bed between the legs, and which casting bed is mountable on or by another casting bed, thereby enabling vertical stacking of a plurality of the casting beds.

9. In an apparatus for manufacturing a plurality of pre-tensioned cast concrete panels, the apparatus comprising the known apparatus of:

a casting bed on which a concrete panel is cast;

a plurality of longitudinally extending reinforcing tendons that become incorporated within the concrete panel cast on the casting bed;

an apparatus to tension the plurality of longitudinally extending tendons between fixings located at opposite ends of the casting bed prior to the casting of concrete;

an apparatus for casting concrete within form members provided on the casting bed to produce the cast concrete panel;

an apparatus to smooth a surface of the concrete that is cast within the form members provided on the casting bed to produce the cast concrete panel with a smooth surface;

an apparatus to release the tensioned plurality of longitudinally extending tendons from the fixings located at the opposite ends of the casting bed after the concrete cast to form the panel has cured, thereby allowing the longitudinally extending plurality of tendons incorporated within the cast concrete panel to shorten and thereby pre-tension the cast concrete panel;

wherein the improvement comprises:

a first set of form members comprising at least two panel end form members, which panel end form members extend generally transversely of the plurality of longitudinally extending tendons with the plurality of longitudinally extending tendons passing therethrough and thereby the panel end form members are positioned anywhere between the ends of the casting bed along the plurality of longitudinally extending tendons passing therethrough;

a second set of form members comprising at least two panel side form members, which panel side form members extend between the panel end form members, so that, the panel end form members and the panel side form members cooperate to create a first assembly, hereinafter referred to as a panel form assembly, which panel form assembly is employed to surround a volume, which panel form assembly is positioned anywhere between the ends of the casting bed along the plurality of longitudinally extending tendons passing therethrough;

a plurality of tie-rods that extend generally transversely of the plurality of longitudinally extending tendons, which plurality of tie-rods are located in a predetermined arrangement within the panel form assembly, which plurality of tie-rods secure together the panel side form members;

a third set of form members, comprising at least two panel end form supporters, which panel end form supporters extend generally transversely of the plurality of longitudinally extending tendons with the plurality of longitudinally extending tendons passing therethrough and thereby the panel end form members are positioned anywhere between the ends of the casting bed along the plurality of longitudinally extending tendons passing therethrough, which panel end form supporters are located at opposite ends and outside of the panel form assembly adjacent to the panel end form members, which panel end form supporters support the panel end form members, and which panel end form supporters locate the panel form assembly on the casting bed during the casting of concrete into the panel form assembly to produce the cast concrete panel.

10. In the apparatus for manufacturing a plurality of pre-tensioned cast concrete panels as claimed in claim 9, including formation of an aperture, for a door or window, within the concrete panel cast within a panel form assembly, comprising the additional apparatus of:

a fourth set of form members, inside the panel end form members at opposite ends of a panel form assembly, comprising at least two aperture end form members, which aperture end form members extend generally transversely of the plurality of longitudinally extending tendons with the plurality of longitudinally extending tendons passing therethrough and thereby the aperture end form members can be positioned anywhere between the panel end form members at opposite ends of the panel form assembly along the plurality of longitudinally extending tendons passing therethrough;

a fifth set of form members, inside the panel side form members, comprising at least two aperture side form members, which aperture side form members extend between the aperture end form members, so that, the aperture end form members and the aperture side form members cooperate to create a second assembly, hereinafter referred to as an aperture form assembly, which aperture form assembly surrounds a volume of air to create a void within the concrete cast to form a panel within the panel form assembly, which aperture form assembly is positioned anywhere between the panel end form members at opposite ends of a panel form assembly along the plurality of longitudinally extending tendons passing therethrough;

a plurality of tie-rods extending generally transversely of the plurality of longitudinally extending tendons, which plurality of tie-rods are located in a predetermined arrangement within the panel form assembly between the panel side form members and the aperture side form members, which plurality of tie-rods secure together the panel side form members and aperture side form members;

a sixth set of form members within the aperture form assembly comprising an aperture skeleton frame, which aperture skeleton frame supports the aperture end form members at opposite ends of the aperture form assembly, and which aperture skeleton frame secures together the aperture side form members within the aperture form assembly.

11. In the apparatus for manufacturing a plurality of pre-tensioned cast concrete panels as claimed in claim 9, further comprising:

a plurality of tie-rods in a predetermined arrangement extending generally transversely of the plurality of longitudinally extending tendons tensioned between the ends of the casting bed, which plurality of tie-rods in the predetermined arrangement, in the panel form assembly, secures together the panel side form members, which plurality of tie-rods in the predetermined arrangement is employed for securement of lifting apparatus to aid in lifting the panel cast within the panel form assembly, and which plurality of tie-rods in the predetermined arrangement is employed for securement of fasteners to connect the panel cast within the panel form assembly to other building elements.

12. In the apparatus for manufacturing a plurality of pre-tensioned cast concrete panels as claimed in claim 10, further comprising:

a plurality of tie-rods in a predetermined arrangement extending generally transversely of the plurality of longitudinally extending tendons tensioned between the ends of the casting bed, which plurality of tie-rods in the predetermined arrangement, in the panel form assembly, secures together the panel side form members, which plurality of tie-rods in the predetermined arrangement, when the aperture form assembly is employed within the panel form assembly, secures together the aperture form assembly within the panel form assembly, which plurality of tie-rods in the predetermined arrangement is employed for securement of lifting apparatus to aid in lifting the panel cast within the panel form assembly, and which plurality of tie-rods in the periodic modular arrangement is employed for securement of fasteners to connect the panel cast within the panel form assembly to other building elements.

13. In the apparatus for manufacturing a plurality of pre-tensioned cast concrete panels as claimed in claim 9, further comprising:

at least two panel end form supporters, which panel end form supporters extend generally transversely of the plurality of longitudinally extending tendons with the plurality of longitudinally extending tendons passing therethrough, which panel end form supporters are located at opposite ends and outside of the panel form assembly adjacent to the panel end form members, which panel end form supporters locate the panel form assembly on the casting bed and support the panel end form members, each of which panel end form supporters is fabricated as a mirror image around a centre line so that a plurality of panel form assemblies are banked on the casting bed and hence the plurality of panels is cast in a continuous batch operation, which panel end form supporters create separation between the panels cast within the banked panel form assemblies and thereby enables the tendons to be cut.

14. In the apparatus for manufacturing a plurality of pre-tensioned cast concrete panels as claimed in claim 10, further comprising:

at least two panel end form supporters, which panel end form supporters extend generally transversely of the plurality of longitudinally extending tendons with the plurality of longitudinally extending tendons passing therethrough, which panel end form supporters are located at opposite ends and outside of the panel form assembly adjacent to the panel end form members, which panel end form supporters locate the panel form assembly on the casting bed and support the panel end form members, each of which panel end form supporters is fabricated as a mirror image around a centre line so that a plurality of panel form assemblies are banked on the casting bed and hence the plurality of panels is cast in a continuous batch operation, which panel end form supporters create separation between the panels cast within the banked panel form assemblies and thereby enables the tendons to be cut.

15. In the apparatus for manufacturing a plurality of pre-tensioned cast concrete panels as claimed in claim 9, further comprising:

the casting bed with an upwards facing, generally planar surface to receive the panel form assembly so that concrete cast within the panel form assembly produces the cast concrete panel, which casting bed has fixings located at opposite ends of the casting bed employed to tension the plurality of longitudinally extending tendons prior to the casting of concrete, which casting bed is supported on legs located only at opposite ends of the casting bed, which legs raise the casting bed to create a clear space under the casting bed between the legs, and which casting bed is mounted on or by another casting bed, thereby enabling a plurality of casting beds to be stacked vertically.

16. In the apparatus for manufacturing a plurality of pre-tensioned cast concrete panels as claimed in claim 10, further comprising:

the casting bed with an upwards facing, generally planar surface to receive the panel form assembly so that concrete cast within the panel form assembly produces the cast concrete panel, which casting bed has fixings located at opposite ends of the casting bed employed to tension the plurality of longitudinally extending tendons prior to the casting of concrete, which casting bed is supported on legs located only at opposite ends of the casting bed, which legs raise the casting bed to create a clear space under the casting bed between the legs, and which casting bed is mounted on or by another casting bed, thereby enabling a plurality of casting beds to be stacked vertically.

* * * * *